US009290038B2

(12) United States Patent
Colella

(10) Patent No.: US 9,290,038 B2
(45) Date of Patent: Mar. 22, 2016

(54) HEAT TRANSFER LABELS AND METHOD OF MAKING SAME

(71) Applicant: Illinois Tool Works Inc., Glenview, IL (US)

(72) Inventor: Michael B. Colella, Southington, CT (US)

(73) Assignee: Illinois Tool Works Inc., Glenview, IL (US)

( * ) Notice: Subject to any disclaimer, the term of this patent is extended or adjusted under 35 U.S.C. 154(b) by 37 days.

(21) Appl. No.: 14/287,562

(22) Filed: May 27, 2014

(65) Prior Publication Data

US 2014/0356592 A1 Dec. 4, 2014

Related U.S. Application Data

(60) Provisional application No. 61/828,008, filed on May 28, 2013.

(51) Int. Cl.

| | |
|---|---|
| ***B41M 3/12*** | (2006.01) |
| ***B44C 1/16*** | (2006.01) |
| ***B44C 1/17*** | (2006.01) |

(52) U.S. Cl.

CPC ..... *B44C 1/1712* (2013.01); *B44C 1/162* (2013.01); *B41M 3/12* (2013.01); *Y10T 428/24851* (2015.01)

(58) Field of Classification Search

CPC ..... B41M 3/12; B44C 1/16; B44C 1/162; B44C 1/17; B44C 1/1712; Y10T 428/24851

USPC ..... 428/32.79; 156/240; 427/207.1

See application file for complete search history.

(56) References Cited

U.S. PATENT DOCUMENTS

| | | | |
|---|---|---|---|
| 3,922,435 | A | 11/1975 | Anses |
| 5,919,834 | A | 7/1999 | Downs et al. |
| 2012/0070595 | A1 | 3/2012 | Sloat et al. |

FOREIGN PATENT DOCUMENTS

| | | | |
|---|---|---|---|
| WO | 2012003075 | A1 | 1/2012 |

OTHER PUBLICATIONS

Annex to Form PCT/IS/206 Communication Relating to the Results of the Partial International Search for PCT/US2014/039555 dated Sep. 9, 2014.

*Primary Examiner* — Bruce H Hess

(74) *Attorney, Agent, or Firm* — Levenfeld Pearlstein, LLC

(57) ABSTRACT

A substantially halo-free heat transfer label is made using a 3D printing method. The heat transfer label includes a graphic layer and an adhesive layer. The adhesive layer is printed using a 3D printing method, which provides a substantially reduced adhesive halo when compared to heat transfer labels including a screen printed adhesive layer or that printed via other conventional printing methods.

18 Claims, 3 Drawing Sheets

HEAT TRANSFER LABELS AND METHOD OF MAKING SAME

CROSS-REFERENCE TO RELATED APPLICATION DATA

The present application claims the benefit of and priority to Provisional U.S. Patent Application Ser. No. 61/828,008, filed May 28, 2013, the disclosure of which is incorporated herein by reference in its entirety.

BACKGROUND

The present disclosure generally relates to heat transfer labels, and more particularly to heat transfer labels with reduced halo and a method of making the same.

Heat transfer labels are well known and used in various industries. For example, heat transfer labels are widely used in apparel industries. Heat transfer labels are often screen printed using solvent based inks Typically, heat transfer labels require an adhesive layer to attach the label to a substrate. For example, apparel labels typically include an adhesive layer having a thickness of about 50-100 micrometers or thicker to provide adequate adhesion between the label and a textured surface of garments to which they are applied. Such a thick adhesive layer often requires several screen printing passes to achieve the desired thickness.

Thus, it is not unusual for the adhesive component to make up 80-95% of the total volume of a heat transfer label. Adhesives for screen printed apparel labels are usually prepared as a dispersion of an insoluble hot melt adhesive powder in a compatible solution of resin and solvent. Thus, the adhesive component, which makes up a substantial volume of the label, often is responsible for the majority of volatile organic compounds (VOC) associated with the printing of the label. Further, a relatively thick layer of adhesive printed using a solvent based adhesive ink can retain solvent, causing undesirable odors when the label is applied.

In addition to VOC and multiple printing passes required to provide an adequate thickness of the adhesive layer, screen printed heat transfer labels also exhibit an undesirable "halo". Different printing presses and methods have a different "color to color tolerance" associated with a particular printing press and/or method. This tolerance is determined by the press movements, which are inherent in the printing equipment. To accommodate the "color to color tolerance" of a screen printing process, an adhesive layer of a heat transfer label is printed larger than graphic layers to ensure that the adhesive layer is behind all of the graphic layers. For example, if the "color to color tolerance" of a screen printing press is ±0.25 mm, under optimum conditions, there will be an even border of adhesive extending 0.25 mm around the entire graphic layer. Under some less optimal conditions, there will be an uneven border of adhesive, for example, some parts extending more than 0.25 mm beyond the graphic layer and some parts with nearly no adhesive border. Thus, the adhesive layer is sized according to the tolerance of the particular equipment and/or printing method to ensure that the adhesive layer is behind the entire graphic layers even in the worst expected conditions, such that the label can be applied to a substrate successfully. However, such an adhesive border creates a "halo" around the graphic portion of a label, which is visible on the substrate after the label is applied. Many end users find these adhesive halos aesthetically undesirable.

Efforts have been made to develop alternative printing methods to reduce VOC from solvent based printing methods. For example, extrusion coating and powder coating methods use solid powder adhesives without a solvent. In extrusion coating, a layer of adhesive is extruded over graphic areas. However, this method does not address the "halo" effect, because a layer of adhesive, which is applied across the entire support film covering graphic areas and open areas between the graphic areas, creates a "halo" that may be even larger than that of one produced by screen printing.

In powder coating, a powder adhesive is applied over the last wet ink pass, and the powder coated surface is brushed to remove the powder adhesive that did not stick to the wet ink. Subsequently, the powder adhesive coated label is heated to melt and distribute the adhesive. Thus, in theory, only the adhesive particles that are adhered to the wet ink remain on the label, and thus, no adhesive "halo" will be created with this method. However, this will only work for labels that have all the graphics backed with one backer color, since it requires a wet pass of ink to hold the powder in place before the fusion step. Thus, if the entire label is backed by a white ink, for example, the powder adhesive can be applied over the entire graphic label without an adhesive "halo". However, for labels including different backer colors for different portions of the graphic label, an extra clear coat must be applied as the last print pass to provide a wet ink surface for the powder to adhere. However, such a clear backing will create a "halo" similar to the adhesive "halo". Further, powder coating can be messy and pose difficulties in maintaining a clean manufacturing environment.

Accordingly, there is a need for improved heat transfer labels and a method of making the same, in which the "halo" is minimized and VOC is reduced.

BRIEF SUMMARY

A substantially halo-free heat transfer label, and a method of making the same are provided according to various embodiments. The heat transfer label includes an adhesive layer, which is printed using a 3D printing method. By printing the adhesive layer via a 3D printing method, an adhesive halo around a graphic area can be significantly reduced when compared to those made using conventional printing methods, such as screen printing. Further, 3D printing uses solid adhesives without a solvent, thus, VOC from conventional solvent based printing can be eliminated or significantly reduced.

In one aspect, a substantially halo-free heat transfer label is provided. The substantially halo-free heat transfer label includes a graphic layer printed on a carrier layer forming a graphic area, and an adhesive layer printed over the graphic layer forming an adhesive area. The adhesive area substantially matches and overlaps the graphic area, and peripheral edges of the adhesive area extend beyond peripheral edges of the graphic area forming an adhesive border having an average width of less than about 0.15 mm to provide a substantially halo-free heat transfer label. The heat transfer label is configured such that the graphic layer and the adhesive layer transfer to a substrate upon application of heat and pressure, in which the graphic layer is attached to the substrate by the adhesive layer.

In some embodiments, the graphic layer may include at least two different backer colors. In another embodiment, the average width of the adhesive border around the graphic layer is about 0.05 mm to about 0.10 mm. Further, in any of the above discussed embodiments, the adhesive layer can comprise a thermoplastic heat activated adhesive.

In another aspect, a method of making a heat transfer label is provided. The method includes steps of printing a graphic layer on a carrier and printing an adhesive layer over the graphic layer, in which the adhesive layer is printed using a 3D printing method.

In some embodiments, the graphic layer may be printed using a screen printing method, a flexographic printing method, a rotogravure printing method, or a pad printing method. In another embodiment, the graphic layer is digitally printed. In yet another embodiment, the graphic layer is printed using a 3D printing method.

In one embodiment, the adhesive layer may be printed using a fused deposition modeling (FDM) 3D printing method. In such an embodiment, the adhesive layer can be printed using a thermoplastic adhesive. The thermoplastic adhesive can comprise a copolyester resin, a copolyamide resin, a thermoplastic polyurethane resin, and/or a nylon multipolymer resin.

In another embodiment, the adhesive layer may be printed using a stereolithography (STL) 3D printing method.

In any of the above discussed embodiments, the graphic layer is printed to form a graphic area on the carrier, and the adhesive layer is printed over the graphic area to form an adhesive area. The adhesive layer is printed such that the adhesive area substantially matches and overlaps the graphic area, and peripheral edges of the adhesive area extend beyond peripheral edges of the graphic area to form an adhesive border having an average width of less than about 0.15 mm. In some embodiments, the average width of the adhesive border around the graphic area may be about 0.05 mm to about 0.10 mm.

Other aspects, objectives and advantages will become more apparent from the following detailed description when taken in conjunction with the accompanying drawings.

BRIEF DESCRIPTION OF THE DRAWINGS

The benefits and advantages of the present embodiments will become more readily apparent to those of ordinary skill in the relevant art after reviewing the following detailed description and accompanying drawings, wherein.

DETAILED DESCRIPTION

Figure 1:
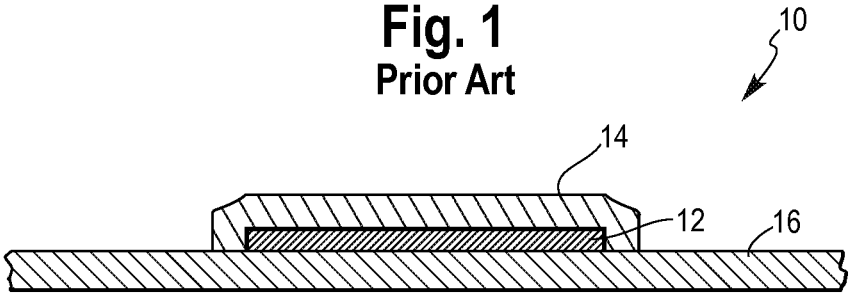
Fig. 1 Prior Art
FIG. 1 is a schematic cross sectional view of a prior art heat transfer label.

While the present disclosure is susceptible of embodiment in various forms, there is shown in the drawings and will hereinafter be described presently preferred embodiments with the understanding that the present disclosure is to be considered an exemplification and is not intended to limit the disclosure to the specific embodiments illustrated. The words "a" or "an" are to be taken to include both the singular and the plural. Conversely, any reference to plural items shall, where appropriate, include the singular.

Figure 2:
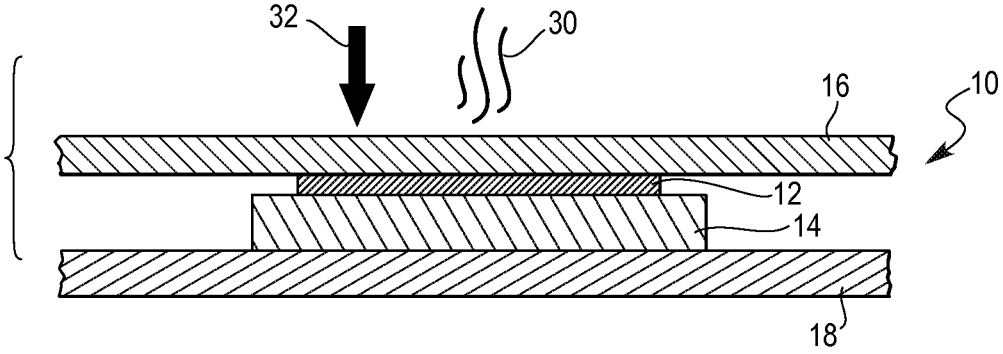
Fig. 2 Prior Art
FIG. 2 is a schematic cross sectional view of the prior art heat transfer label of FIG. 1 placed on a substrate.
Figure 3:
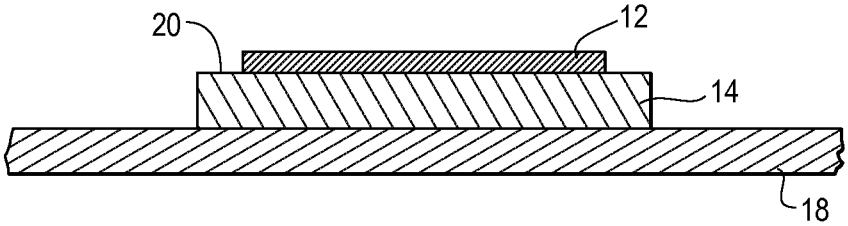
Fig. 3 Prior Art
FIG. 3 is a schematic cross sectional view of the prior art heat transfer label of FIG. 1 transferred onto the substrate.

Referring to figures, FIGS. 1-3 illustrate a prior art heat transfer label 10 made via a conventional printing process, such as screen printing. A schematic cross sectional view of the heat transfer label 10 is shown in FIG. 1. The heat transfer label 10 generally includes a graphic layer 12 and an adhesive layer 14 on a carrier layer 16. Layer thicknesses are exaggerated for easy understanding and are not proportional. Although the graphic layer 12 is illustrated as a single layer, it can include multiple color graphics, a top protective layer and/or a backing layer, such as a white backing layer. For apparel applications, the adhesive layer 14 is typically substantially thicker than the graphic layer 12. For example, the adhesive layer 14 can have a thickness of about 50-100 μm. In such embodiments, the adhesive layer 14 typically requires multiple printing passes to provide such a thickness.

In screen printing, the graphic layer 12 is printed on the carrier layer 16 first. Subsequently, the adhesive layer 14 is printed over the graphic layer 12. As shown in FIG. 1, the adhesive layer 14 is printed in a larger area than the graphic layer 12, such that peripheral edges of the adhesive layer 14 extend beyond the peripheral edges of the graphic layer 12. The adhesive area to be printed is calculated to accommodate tolerances of the printing equipment and process used to print the label. For example, a screen printing press can have a color to color tolerance of about ±0.25 mm. In such a case, the adhesive layer 14 is printed, such that an overhang around the graphic layer 12, which is also referred to as an adhesive border, has an average width of about 0.25 mm.

As shown in FIG. 2, the heat transfer label 10 is placed on a substrate 18, for example, a shirt fabric, such that the adhesive layer 14 faces the substrate 18. To transfer the label, heat 30 and pressure 32 are applied over the carrier layer 16 with a label applicator. When heat 30 and pressure 32 are applied, the adhesive layer 14 softens and adheres to the substrate 18 permanently. The carrier layer 16 is peeled off, and since the adhesion strength between the graphic layer 12 and the adhesive layer 14 is greater than that between the graphic layer 12 and the carrier layer 16, the graphic layer 12 remains attached to the adhesive layer 14, and transfers to the substrate 18. As shown in FIG. 3, the adhesive layer 14, which is printed in a larger area than the graphic layer 12, creates an adhesive border 20, which is commonly referred to as a "halo" in the industry.

Figure 7:
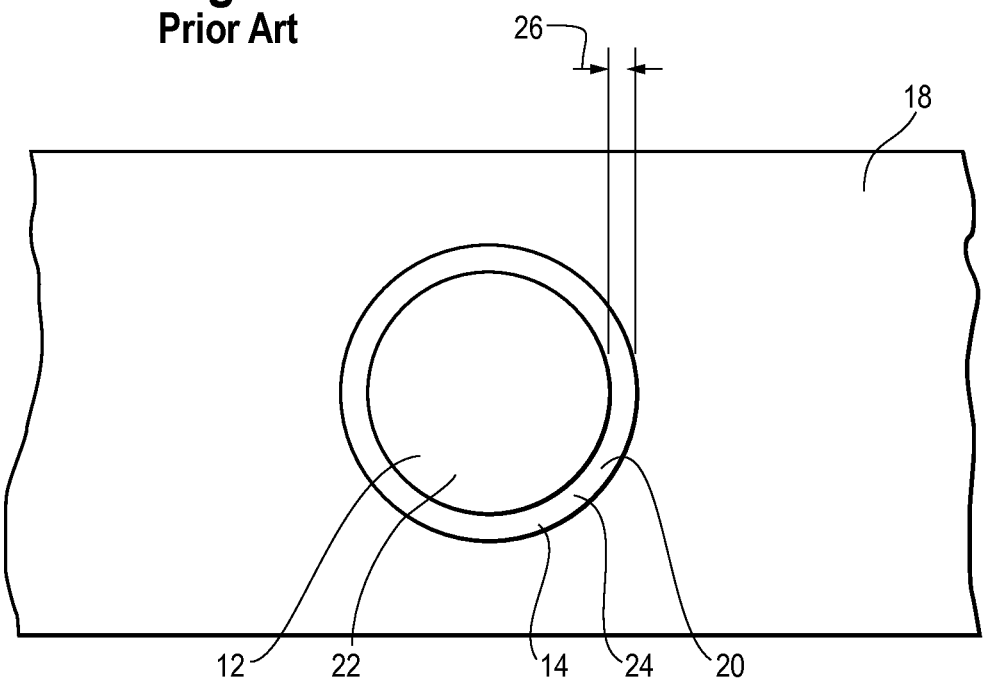
Fig. 7 Prior Art
FIG. 7 is a perspective top view of the prior art heat transfer label of FIG. 1 on a substrate.

FIG. 7 is a perspective top view the prior art heat transfer label 10 transferred and attached on the substrate 18 as shown in FIG. 3. The graphic layer 12 has a circular shaped graphic area 22, and the adhesive layer 14 has a similar circular shaped adhesive area 24, which is larger than the graphic area 22. Thus, the peripheral portions of the adhesive area 24 that extend beyond the graphic area 22 are visible as the adhesive border or halo 20. Although, the halo 20 around the graphic area 22 in FIG. 7 has a width 26, which appears to be substantially even around the graphic area 22, the width 26 can be uneven with some portions of the halo 20 extending more and some less, depending on process conditions. Screen printed heat transfer labels typically have an average width of halo of about 0.25 mm. Such a halo around the graphic area is considered aesthetically undesirable in the industry.

Figure 4:
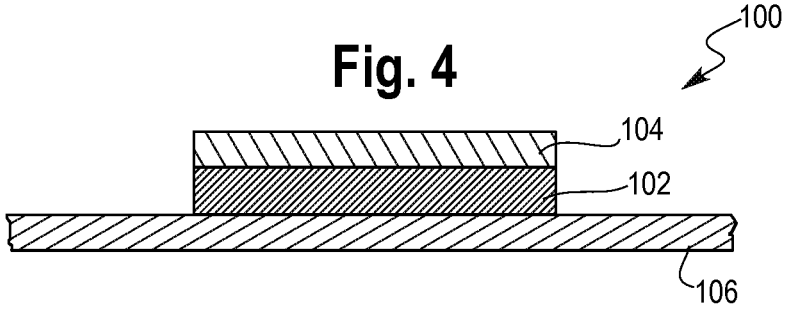
FIG. 4 is a schematic cross sectional view a heat transfer label according to an embodiment.
Figure 5:
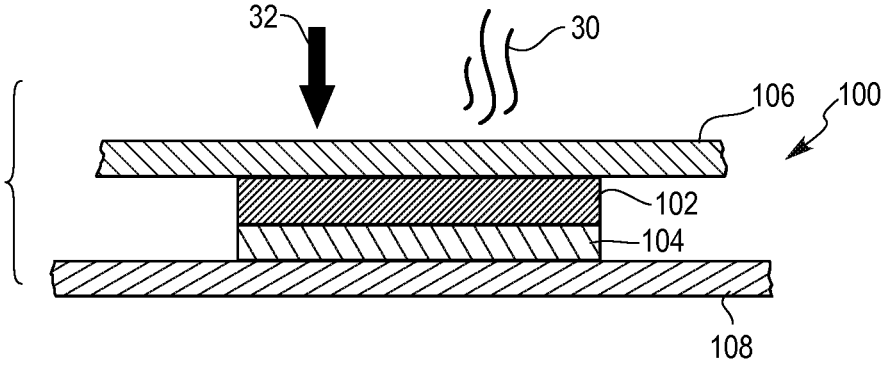
FIG. 5 is a schematic cross sectional view of the heat transfer label of FIG. 4 placed on a substrate.
Figure 6:
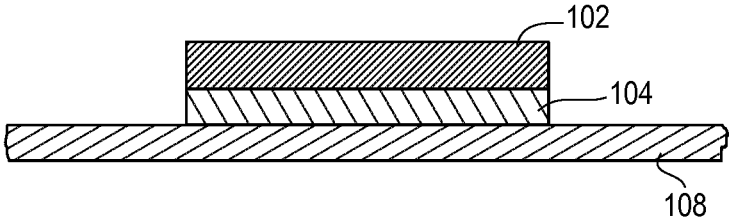
FIG. 6 is a schematic cross sectional view of the heat transfer label of FIG. 4 transferred onto the substrate.

FIGS. 4-6 illustrate a heat transfer label 100 according to an embodiment of the present disclosure. A schematic cross sectional view of the heat transfer label 100 is shown in FIG. 4. The heat transfer label 100 generally includes a graphic layer 102 and an adhesive layer 104 on a carrier layer 106. Layer thicknesses are exaggerated for easy understanding and are not proportional. Although the graphic layer 102 is illustrated as a single layer, it can include multiple color graphics, a top protective layer and/or a backing layer, such as a white backing layer. For apparel applications, the adhesive layer 104 is typically substantially thicker than the graphic layer 102. For example, the adhesive layer 104 can have a thickness of about 50-100 μm.

As shown in FIGS. 4-6, the adhesive layer 104 is printed over the graphic layer 102, such that peripheral edges of the graphic layer 104 and peripheral edges of the adhesive layer 104 overlap each other substantially without an overhang or a border. Thus, an adhesive "halo" around the graphic layer 102 is substantially reduced when compared to that of prior art heat transfer labels, in which the adhesive layer is screen printed or printed using other conventional printing methods.

In one embodiment, the graphic layer 102 is screen printed on the carrier layer 106. The graphic layer 102 can also be printed using other conventional printing methods, such as flexographic, rotogravure, or pad printing methods. The graphic layer 102 can be printed via a single or multiple printing passes. Typically, the graphic layer 102 will include multiple colors, which require multiple printing passes. Additionally, the graphic layer 102 may also include a protective layer and/or a backing layer, which will require additional printing passes. In some embodiments, the graphic layer 102 can include more than one backer colors.

The carrier layer 106 can be formed from a paper or plastic film. Suitable materials for the carrier layer 106 include polypropylene film, as well as polyester films, with polyester being more heat resistant. MYLAR® and MELINEX® are two trademarks under which these materials are commercially available. Paper is less costly than plastic films, however, the dimensional stability of paper is less desirable unless printing is conducted in a controlled environment with regard to temperature and relative humidity. Preferably, the carrier layer 106 is a release coated paper or plastic film. The release coating can be silicone based, or it can employ other coatings that will be recognized by those skilled in the art. In some embodiments, both sides of the carrier layer 106 are coated with release coatings, in which the release coatings have different release characteristics. For example, the printed side will generally have a tighter release than the non-printed side.

The adhesive layer 104 can be formed from a suitable heat activated adhesive, which softens and forms a permanent bond with a substrate when subjected to heat and pressure. The adhesive layer 104 is printed over the graphic layer 102 using a 3D printing method. 3D printing is an additive process, in which successive layers of material are laid down to form different shapes. 3D printing is typically used to make three-dimensional solid objects of virtually any shape from a digital model. From a computer aided design (CAD) file of an image, a 3D printer builds layer upon layer to reproduce the image. There are several different techniques for the printer to build an image.

For example, fused deposition modeling (FDM) or stereolithography (STL) printing techniques may be used to print the adhesive layer 104. The FDM and STL 3D printing methods use 100% solids adhesives without the need of a solvent, and thus, VOC associated with conventional solvent based printing methods can be eliminated. FDM methods use a thermoplastic ink and/or adhesive that is melted and printed. STL methods use a liquid photopolymer which is cured with an energy source, such as a UV energy source. As such, the ink and/or adhesive used for STL methods is a 100% solids ink/adhesive, since 100% of what was deposited becomes a solid ink/adhesive layer after being cured. Further, 3D printers used in these methods are operated by digital print engines, and thus, have the same precision associated with conventional digital printers. For example, the precision in the X-Y direction can be in the 0.05-0.10 mm range, which is much smaller than the tolerances of typical screen printing processes or other similar conventional printing processes. Thus, the heat transfer labels including an adhesive layer printed via 3D printing processes can provide a label with a substantially reduced "halo" or essentially a "halo" free label. Further, depending on printer nozzle geometry, a 3D printer can print a layer having a thickness of about 16-100 μm in a single pass. Thus, a desired thickness of the adhesive layer 104 can be printed in one pass via a 3D printing method, replacing multiple print passes required in screen printing or other conventional printing methods.

In one embodiment, a FDM method is used to print the adhesive layer 104 using a 3D printer. In this embodiment, a thermoplastic adhesive is extruded in small beads from an extrusion head to form the adhesive layer 104. Stepper motors or servo motors are typically used to move the extrusion head. Suitable thermoplastic adhesives for the FDM method include, but are not limited to, copolyester and copolyamide hot melt adhesives (e.g. Griltex® from EMS-Griltech), nylon multipolymer resins (e.g. Elvamide® from DuPont), copolyamides (e.g. Vestamelt® from Evonik), copolyesters (e.g. Dynapol® from Evonik.), and thermoplastic polyurethane resins (e.g., Unex TPU from Dakota).

In another embodiment, a STL method is used to print the adhesive layer 104. In this embodiment, a liquid photopolymer composition is applied using a 3D printer and cured with an energy source, for example, a UV light source, after printing each layer. A photopolymer composition may contain monomers and/or oligomers and photoinitiators, which can be cured under a UV energy source. The photopolymer composition may also contain a thermoplastic resin. Suitable photopolymer compositions having sufficient thermoplastic characteristics for heat transfer labels include photopolymer compositions including at least one thermoplastic resin, such as those disclosed in Downs et al., U.S. Pat. No. 5,919,834, which is assigned to the assignee of the present application and incorporated herein by reference.

In some embodiments, the graphic layer 102 is also printed using a 3D printing method or digitally printed.

As shown in FIG. 5, the heat transfer label 100 is placed on a substrate 108, for example, a shirt fabric, such that the adhesive layer 104 faces the substrate 108. Then heat 30 and pressure 32 are applied over the carrier layer 106 with a heat press machine, such as a label applicator. When heat 30 and pressure 32 are applied, the adhesive layer 104 softens and adheres to the substrate 108 permanently. The carrier layer 106 is peeled off, and since the adhesion strength between the graphic layer 102 and the adhesive layer 104 is greater than that between the graphic layer 102 and the carrier layer 106, the graphic layer 102 remains attached to the adhesive layer 104, and transfers to the substrate 108. As shown in FIG. 6, when the heat transfer label 100 is applied on the substrate 108, the adhesive layer 104 that is printed over the graphic layer 102 substantially without an overhang via a 3D printing method, provides a label that is substantially "halo" free.

Figure 8:
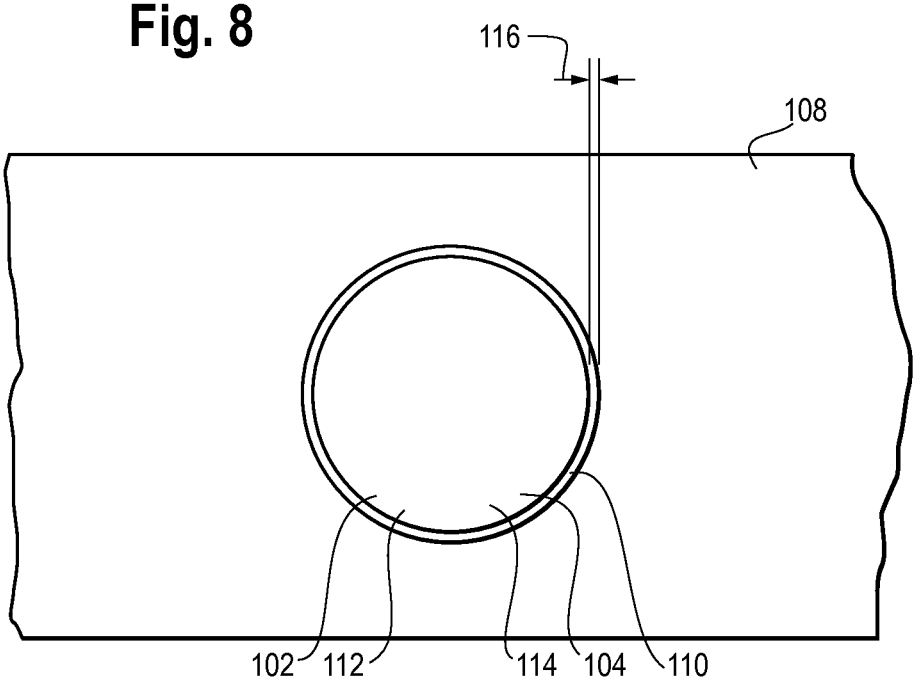
FIG. 8 is a perspective top view of the heat transfer label of FIG. 4 on a substrate.

FIG. 8 is a perspective top view a heat transfer label transferred and attached on a substrate 18 according to one embodiment. A graphic layer 102 has a circular shaped graphic area 112, and an adhesive layer 104 has a similar circular shaped adhesive area 114. The adhesive layer 104 is printed using a 3D printer with a tolerance range between about 0.05 mm to about 0.10 mm. Thus, in this embodiment, the adhesive layer 104 is printed over the graphic layer 102, such that the adhesive area 114 is slightly larger than the graphic area 112 to accommodate the 3D printer tolerance. Thus, the peripheral portions of the adhesive area 114 extend beyond the graphic area 112 slightly creating an adhesive border 110 with an average width 116 of less than about 0.10 mm. However, as can be seen by comparing with the prior art label of FIG. 7, the label of FIG. 8 has a significantly reduced halo than that of FIG. 7.

From the foregoing it will be observed that numerous modifications and variations can be effectuated without departing from the true spirit and scope of the novel concepts of the present disclosure. It is to be understood that no limitation with respect to the specific embodiments illustrated is intended or should be inferred. The disclosure is intended to cover by the appended claims all such modifications as fall within the scope of the claims.

What is claimed is:

1. A substantially halo-free heat transfer label, comprising:

a graphic layer printed on a carrier layer forming a graphic area; and an adhesive layer 3D printed over the graphic layer forming an adhesive area;

wherein the adhesive area substantially matches and overlaps the graphic area, and peripheral edges of the adhesive area extend beyond peripheral edges of the graphic area forming an adhesive border having an average width of less than about 0.15 mm to provide a substantially halo-free heat transfer label.

2. The substantially halo-free heat transfer label of claim 1, wherein the graphic layer includes at least two different backer colors.

3. The substantially halo-free heat transfer label of claim 1, wherein the heat transfer label is configured such that the graphic layer and the adhesive layer transfer to a substrate upon application of heat and pressure, wherein the graphic layer is attached to the substrate by the adhesive layer.

4. The substantially halo-free heat transfer label of claim 1, wherein the average width of the adhesive border around the graphic layer is about 0.05 mm to about 0.10 mm.

5. The substantially halo-free heat transfer label of claim 1, wherein the adhesive layer comprises a thermoplastic heat activated adhesive.

6. The substantially halo-free heat transfer label of claim 1, wherein the adhesive layer comprises a photopolymer composition containing a monomer and/or an oligomer, a photoinitiator, and a thermoplastic resin.

7. A method of making a heat transfer label, comprising steps of:

printing a graphic layer on a carrier;

printing an adhesive layer over the graphic layer; and wherein the adhesive layer is printed using a 3D printing method.

8. The method of claim 7, wherein the graphic layer is printed using a screen printing method, a flexographic printing method, a rotogravure printing method, or a pad printing method.

9. The method of claim 7, wherein the graphic layer is digitally printed.

10. The method of claim 7, wherein the graphic layer is printed using a 3D printing method.

11. The method of claim 7, wherein the adhesive layer is printed using a fused deposition modeling (FDM) 3D printing method.

12. The method of claim 11, wherein the adhesive layer is printed using a thermoplastic adhesive.

13. The method of claim 12, wherein the thermoplastic adhesive comprises a copolyester resin, a copolyamide resin, a nylon multipolymer resin, and/or a thermoplastic polyurethane resin.

14. The method of claim 7, wherein the adhesive layer is printed using a stereolithography (STL) 3D printing method.

15. The method of claim 14, wherein the adhesive layer is printed using a photopolymer composition containing a monomer and/or an oligomer and a photoinitiator, wherein the photopolymer composition is cured upon exposure to a UV energy source.

16. The method of claim 15, wherein the photopolymer composition further contains a thermoplastic resin.

17. The method of claim 7, wherein the graphic layer is printed to form a graphic area on the carrier, and the adhesive layer printed over the graphic area to form an adhesive area, wherein the adhesive layer is printed such that the adhesive area substantially matches and overlaps the graphic area, and peripheral edges of the adhesive area extend beyond peripheral edges of the graphic area forming an adhesive border having an average width of less than about 0.15 mm.

18. The method of claim 17, wherein the average width of the adhesive border around the graphic area is about 0.05 mm to about 0.10 mm.

* * * * *